United States Patent [19]

della Porta

[11] Patent Number: 4,938,667

[45] Date of Patent: Jul. 3, 1990

[54] METHOD FOR THE MANUFACTURE OF A VACUUM INSULATING STRUCTURE AND AN INSULATING STRUCTURE SO PRODUCED

[75] Inventor: Paolo della Porta, Milan, Italy

[73] Assignee: SAES Getters Spa, Milan, Italy

[21] Appl. No.: 372,323

[22] Filed: Jun. 28, 1989

[30] Foreign Application Priority Data

Sep. 30, 1988 [IT] Italy ..... 2155 A/88

[51] Int. Cl.[5] ..... F04B 37/02

[52] U.S. Cl. ..... 417/48; 417/51

[58] Field of Search ..... 417/48, 51; 220/420, 220/421; 215/13.1

[56] References Cited

U.S. PATENT DOCUMENTS

| | | | |
|---|---|---|---|
| 3,114,469 | 12/1963 | Francis et al. | 417/48 X |
| 3,439,870 | 4/1969 | Vedder | 417/51 |
| 3,662,522 | 5/1972 | della Porta et al. | 417/51 X |
| 4,272,259 | 6/1981 | Patterson et al. | 417/48 X |

*Primary Examiner*—John C. Fox

*Attorney, Agent, or Firm*—David R. Murphy

[57] ABSTRACT

A method is described for the manufacture of a vacuum insulating structure intended mainly, but not exclusively, for use in such domestic appliances as refrigerators or freezers as well as for vehicle walls including aeroplanes and in buildings. A hollow plastic or metal panel is purged to atmospheric air by means of a getterable gas. Vacuum is produced by removing the purge gas and the vacuum is subsequently maintained by contacting the residual gas with a getter material. A vacuum insulating structure thus manufactured is also described.

9 Claims, 1 Drawing Sheet

FIG.1
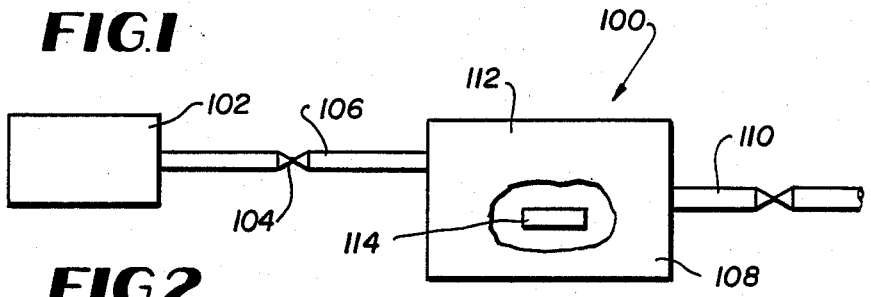
FIG.2
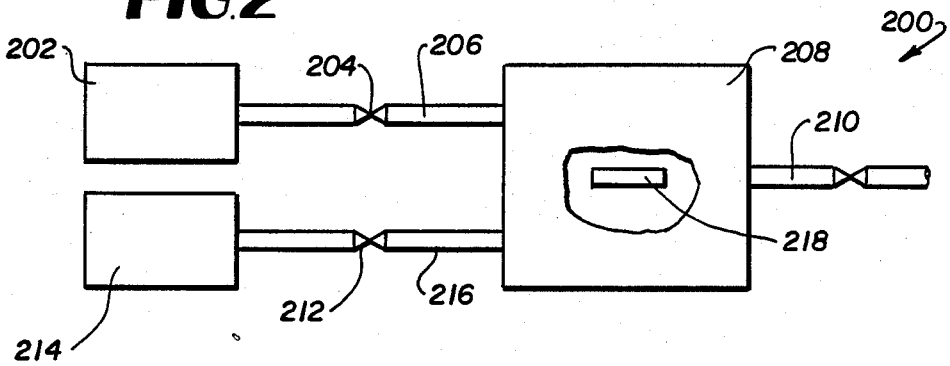
FIG.3
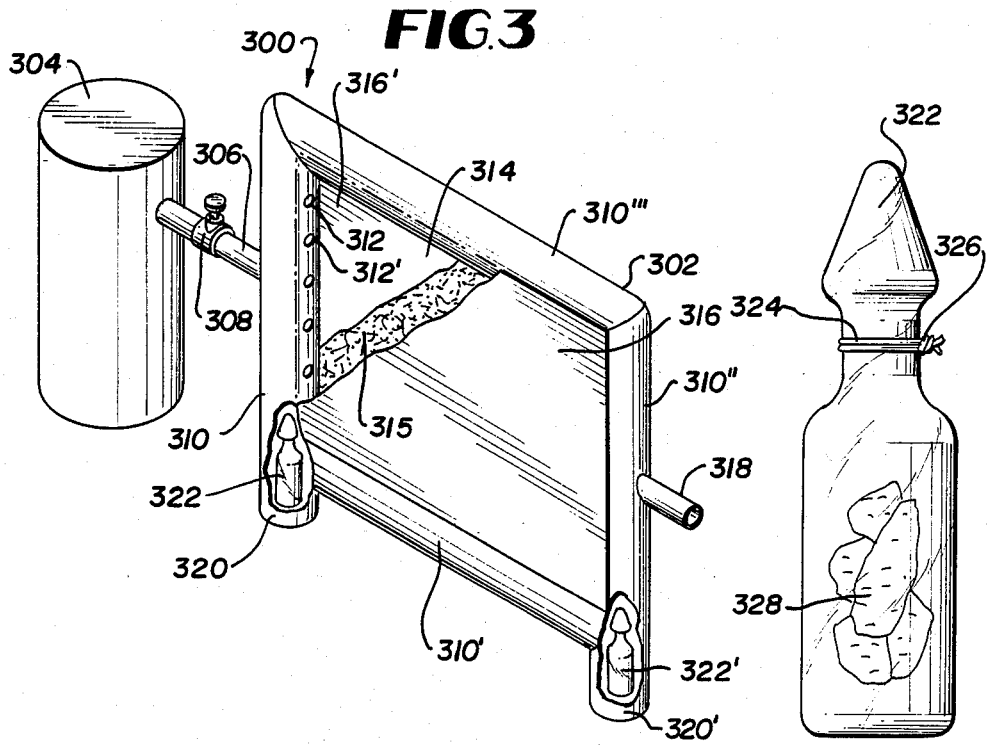
FIG.4

METHOD FOR THE MANUFACTURE OF A VACUUM INSULATING STRUCTURE AND AN INSULATING STRUCTURE SO PRODUCED

BACKGROUND TO THE INVENTION

Thermal insulation is a widely used method of reducing undesirable heat gains or losses to a minimum. One extremely efficient method of providing thermal insulation is to use an evacuated enclosure such as disclosed in U.S. Pat. Nos. 4,546,798, and 3,680,631. However, such evacuated enclosures usually involve the use of walls of fragile glass, or heavy and expensive metals. Expensive vacuum pumps are necessary and the time required to pump the enclosure down to the required vacuum level can be excessive, in many applications. While such materials and costs can be justified in sophisticated applications such as chemical plants, oil gathering and the aerospace industry, etc., they are totally unacceptable in the requirements for the mass production of consumer goods.

For instance a non-limiting example is in the manufacture of domestic or "semi-industrial" refrigerators where, for economy of energy consumption, it is necessary to thermally insulate the cold storage space. This is presently accomplished by the use of sheets of foamed plastic material. Unfortunately the production of this foamed plastic makes use of chlorinated hydrocarbons whose widescale use is considered to be an ecological disaster and legislation is gradually being introduced to drastically reduce or eliminate their use.

In an attempt to provide an alternative insulating medium to foamed plastic it has been proposed to utilize plastic bags filled with a fibrous or powdered insulating medium and subsequently evacuated. However there have been found problems of gas permeation through the plastic bag causing loss of vacuum and hence thermal insulation. Creating the original vacuum is a lengthy process due to restricting conductances through pumping tubulations. Outgassing of the components during life again contributing to loss of vacuum is a problem. A getter device, to maintain the vacuum has been suggested but it must be heated, to cause it to sorb gases, at temperatures higher than the melting point of the plastics used.

OBJECTS OF THE PRESENT INVENTION

It is therefore an object of the present invention to provide an improved process for the manufacture of a vacuum insulating structure.

It is another object of the present invention to provide an improved process for the manufacture of a vacuum insulating structure having reduced manufacturing costs.

It is yet another object of the present invention to provide an improved process for the manufacture of a vacuum insulating structure using mainly plastic material.

It is still a further object of the present invention to provide an improved process for the manufacture of a vacuum insulating structure not requiring the use of chlorinated hydrocarbons.

Another object of the present invention is to provide an improved vacuum insulating structure.

These and other objects and advantages of the present invention will become evident to those skilled in the art by reference to the following description and drawings wherein;

BRIEF DESCRIPTION OF THE DRAWINGS

FIG. 1 is a block diagram useful in understanding a preferred method of the present invention.

FIG. 2 is a block diagram useful in understanding an alternative preferred method of the present invention.

FIG. 3 is a schematic partially cutaway view of a vacuum insulation structure being manufactured according to a method of the present invention.

FIG. 4 shows a glass phial useful in the present invention.

DETAILED DESCRIPTION OF THE INVENTION

The method of the present invention for the manufacture of a vacuum insulating structure of the present invention comprises the steps of: flowing a getterable purge gas from a purge gas source which is in fluid contact with said vacuum insulated structure via a purge gas inlet attached to the vacuum insulating structure. Atmospheric air within the insulating structure is thereby expelled through a purge gas outlet attached to the insulating structure, thus producing a purged vacuum insulating structure. The purge gas outlet is closed and the getterable purge gas remaining in the purged vacuum insulating structure is removed by means of a purge gas removal means in fluid contact with the vacuum insulating structure via purge gas sorption conduit to produce a residual gas pressure of less than about 1 mbar within the vacuum insulating structure. The purge gas sorption conduit is then closed and the residual gas is then contacted with a residual gas getter material situated within the vacuum insulating structure.

Referring now to the drawings and in particular to FIG. 1 there is shown a block diagram 100 which will be used to describe one preferred method for the manufacture of a vacuum insulating structure of the present invention. In this case the purge gas source and the purge gas removal means are a single hydrogen storage device 102. The purge gas being used as the getterable gas is hydrogen. Hydrogen is the preferred purge gas as it has a higher flow rate under molecular flow conditions than other gases. Furthermore it is believed to have a chemical cleaning action. Suitable hydrogen storage devices are commercially available for instance from HWT Gesellschaft für Hydrid und Wasserstoff Technik mbH, Germany as model number "KL 114-5." These hydrogen storage devices generally contain metallic hydrides such as those disclosed in German Patent Publication No. 3,210,381 published May 19, 1983 the entire disclosure of which is incorporated herein by reference. Particularly suitable are the hydrided alloys described in Examples 2, 3, 4, and 5 appearing in Columns 5 and 6 of that publication. These hydrogen storage devices release hydrogen at above atmospheric pressure upon heating and re-sorb hydrogen upon cooling. Hydrogen storage device 102 is therefore provided with a heating means (not shown) which may be an electric heating coil situated within the hydrogen storage device 102 or wrapped around the device itself. Alternatively heating may be accomplished simply by immersing the hydrogen storage device 102 within a bath (not shown) of hot water. In operation the hydrogen storage device 102, containing for example metallic hydrides such as ZrH or TiH, is heated to above ambient temperature and upon opening valve 104 hydrogen at above atmospheric pressure is caused to flow through purge gas inlet 106 attached in insulating structure 108 within which it is desired to produce a vacuum and hence a vacuum insulating structure. The above atmospheric pressure of hydrogen thereby expells atmospheric air from within insulating structure 108 through a purge gas outlet 110 also attached to the insulating structure 108. Thus there is produced a purged vacuum insulating structure 112. Purge gas outlet 110 is then crimped to produce a cold welded pressure and vacuum tight seal. The hydrogen storage device 102 is then cooled to remove getterable hydrogen purge gas remaining in the purge gas inlet 106 and the vacuum insulating structure 108 to produce a residual gas pressure of less than about 1 mbar. Valve 104 is closed and then purge gas inlet 106, which in this case also functions as a purge gas sorption conduit is crimped to produce a pressure and vacuum tight seal. The residual gas is then contacted with a residual gas getter material 114 which further reduces the residual gas pressure to about $10^{-2}$ mbar or less and maintains this pressure throughout the life of the vacuum insulating structure.

Referring now to FIG. 2 there is shown a block diagram 200 which will be used to describe an alternative preferred method for the manufacture of a vacuum insulating structure 208 of the present invention. In this case there is provided a separate purge gas source 202 which may be either a high pressure hydrogen gas cylinder or a hydrogen storage device as described above. Valve 204 allows purge gas from purge gas source 202 to flow through a purge gas inlet 206 in fluid contact with vacuum insulating structure 208, thereby expelling atmospheric air through a purge gas outlet 210 also attached to the vacuum insulating structure 208 thus producing a purged vacuum insulating structure. Purge gas outlet 210 is again closed in a pressure and vacuum tight manner. Valve 204 is closed and valve 212 is opened to connect purge gas removal means 214 via a purge gas sorption conduit 216 in fluid contact with the vacuum insulating structure 208. Purge gas removal means 214 may comprise a getter material. Any getter material which can remove the getterable hydrogen purge gas remaining in the purged vacuum insulating structure 208 to produce a residual gas pressure of less than about 1 mbar may be used. The preferred getter material is a non-evaporable getter alloy; most preferably a getter material chosen from the group consisting of;

(a) an alloy of from 5–30% Al balance Zr,
(b) an alloy of from 5–30% Fe balance Zr,
(c) an alloy of from 5–30% Ni balance Zr, and
(d) Zr-$M_1$-$M_2$ alloys wherein $M_1$ is vanadium and/or niobium and $M_2$ is nickel and/or iron.

The purge gas sorption conduit 216 is then sealed in a vacuum tight manner and the residual gas is contacted with a residual gas getter material 218 situated within the vacuum insulating structure 208.

Referring now to FIG. 3 there is shown a schematic partially cut-away view 300 of a vacuum insulating structure 302 being manufactured according to a method as described in conjunction with FIG. 1.

Purge gas source and purge gas removal means are a single hydrogen storage device 304 connected to the vacuum insulating structure 302 by means of purge gas inlet 306 provided with valve 308. The vacuum insulating structure 308 has four hollow tubes 310, 310′, 310″, 310‴, preferably of plastic material but possibly also of thin metal. Hollow tubes 310, 310′, 310″, 310‴ form a substantially rectangular framework. Hollow tube 310 which is connected to purge gas inlet 306 contains a series of gas flow holes such as the holes 312, 312′, which face inwardly towards the volume 314 defined by hollow tubes 310, 310′, 310″, 310‴. Hollow tube 310″ also contains similar inwardly facing gas flow holes (not shown) and is connected to a purge gas outlet 318. Thin plates of plastic or metal 316, 316′ are attached in a gas tight manner to the hollow plastic tubes 310, 310′, 310″, 310‴ further defining volume 314. Volume 314 is filled with an insulating material 315 such as fiber glass or diatomaceous earth. This serves both as an additional insulating element and also prevents deformation of the insulating structure due to either high or low pressures. If, however, excessively high pressures should occur within volume 314 due to a rapid introduction of hydrogen from storage device 304, external containment means can be provided whose rigidity is such as to support the temporary high pressure created within volume 314 thus impeding outward curvature, or even rupture, of plates 316, 316′.

If the four tubes 310, 310′, 310″, 310‴ and the plates 316, 316′ are plastic, it is preferable that all plastic parts be metallized to improve thermal insulation and also to reduce permeation of atmospheric gases into the vacuum insulating structure 302. Hollow tubes 310, 310″ are provided with appendages 320, 320′ respectively, and each containing a rupturable container in the form of glass phials 322, 322′. The glass phials 322, 322′ contain a residual gas getter material. The manufacturing method as described for FIG. 1 is used to produce a vacuum insulating structure. A low temperature (about 100° C.) degassing stage, may be used either before and/or during purging. Preferably the residual gas getter material is a pre-activated getter material chosen from the group consisting of;

(a) an alloy of from 5–30% Al balance Zr,
(b) an alloy of from 5–30% Fe balance Zr,
(c) an alloy of from 5–30% Ni balance Zr, and
(d) Zr-$M_1$-$M_2$ alloys wherein $M_1$ is vanadium and/or niobium and $M_2$ is nickel and/or iron.

The rupturable container is a glass phial 322 as shown in FIG. 4. If appendages 320, 320′ are of relatively flexible plastic material then the glass phial 322 can be ruptured by mechanical means. Alternatively the glass phial may have a weakened area 324 round which a metal wire 326 is formed and upon heating by radio frequency induction heating the phial 322 can be broken; thus contacting the residual gas getter material 328 with the residual gas.

It is to be noted that, besides the above mentioned example related to the manufacture of refrigerators other examples of the use of vacuum insulating panels are in vehicle walls such as automobiles and in particular refrigerated trucks, in aeroplanes and also in buildings such as for "under window" panels in modern buildings which externally appear to be all glass.

Although the invention has been described in considerable detail with reference to certain preferred embodiments designed to teach those skilled in the art how best to practice the invention, it will be realized that other modifications may be employed without departing from the spirit and scope of the appended claims.

What is claimed is:

1. A method for the manufacture of a vacuum insulating structure comprising the steps of;

I. flowing a getterable purge gas from a purge gas source, in fluid contact with said vacuum insulating structure, via a purge gas inlet attached to the vacuum insulating structure thereby expelling atmospheric air through a purge gas outlet attached to the vacuum insulating structure to produce a purged vacuum insulating structure, and;

II. closing said purge gas outlet, and;

III. removing said getterable purge gas remaining in the purged vacuum insulating structure by means of a purge gas removal means in fluid contact with the vacuum insulating structure via a purge gas sorption conduit to produce a residual gas pressure of less than about 1 mbar within the vacuum insulating structure, and;

IV. closing said purge gas sorption conduit, and;

V. contacting the residual gas with a residual gas getter material situated within the vacuum insulating structure.

2. A method of claim 1 in which the purge gas is hydrogen and the purge gas source and the purge gas removal means are a single hydrogen storage device provided with a heating means also comprising the steps of;

i. heating the hydrogen storage device to above ambient temperature to cause the flow of the getterable hydrogen purge gas, and;

ii. cooling the hydrogen storage device to remove said getterable hydrogen purge gas remaining in the purged vacuum insulating structure to produce a residual gas pressure of less than about 1 mbar.

3. A method of claim 1 in which the purge gas flows from a high pressure hydrogen gas cylinder.

4. A method of claim 1 in which the purge gas flows from a hydrogen storage device by heating a metallic hydride.

5. A method of claim 1 in which the purge gas removal means is a getter material chosen from the group consisting of;

(a) an alloy of from 5–30% Al balance Zr (b) an alloy of from 5–30% Fe balance Zr (c) an alloy of from 5–30% Ni balance Zr (d) $Zr\text{-}M_1\text{-}M_2$ alloys wherein $M_1$ is vanadium and/or niobium and $M_2$ is nickel and/or iron.

6. A method of claim 1 in which the residual gas getter material situated within the vacuum insulating structure is contained within a rupturable container in which the residual gas is contacted with the residual gas getter material by rupturing the container.

7. A method of claim 6 in which the getter material is a pre-activated getter material chosen from the group consisting of;

(a) an alloy of from 5–30% Al balance Zr (b) an alloy of from 5–30% Fe balance Zr (c) an alloy of from 5–30% Ni balance Zr (d) $Zr\text{-}M_1\text{-}M_2$ alloys wherein $M_1$ is vanadium and/or niobium and $M_2$ is nickel and/or iron.

and the rupturable container is a glass phial.

8. A vacuum insulating structure manufactured according to claim 1.

9. A method for the manufacture of a vacuum insulating structure comprising the steps of:

I. providing:

A. an insulating structure having an air-filled, insulation-containing zone; and a getter material chosen from the group consisting of;

(a) an alloy of from 5–30% Al balance Zr (b) an alloy of from 5–30% Fe balance Zr (c) an alloy of from 5–30% Ni balance Zr (d) $Zr\text{-}M_1\text{-}M_2$ alloys wherein $M_2$ is vanadium and/or niobium and $M_2$ is nickel and/or iron in a rupturable container within the zone, and an open purge gas outlet; and B. a hydrogen storage device at ambient temperature in fluid communication with the insulating structure via a purge gas sorption conduit wherein the hydrogen storage device contains a metallic hydride which has the property of releasing hydrogen at above ambient temperatures; and then II. heating the hydrogen storage device to above ambient temperature to release hydrogen from the metallic hydride whereupon this hydrogen purges and displaces the air in the insulating structure thereby producing a hydrogen-filled insulating structure; and III. closing said purge gas outlet; and IV. cooling the hydrogen storage device to remove hydrogen from the hydrogen filled insulating structure to produce a residual gas pressure of less than about 1 mbar; and then V. closing said purge gas sorption conduit; and VI. rupturing the rupturable container thereby contacting the hydrogen in the vacuum insulating structure with the getter material thereby sorbing the hydrogen and further reducing the pressure within the vacuum insulating structure.

* * * * *